US007816594B2

(12) United States Patent
Vochezer

(10) Patent No.: US 7,816,594 B2
(45) Date of Patent: Oct. 19, 2010

(54) TUNING PEG

(75) Inventor: Georg Vochezer, Arbenbuehl-Christazhofen (DE)

(73) Assignee: Wittner GmbH & Co. KG, Isny (DE)

( * ) Notice: Subject to any disclaimer, the term of this patent is extended or adjusted under 35 U.S.C. 154(b) by 92 days.

(21) Appl. No.: 12/080,420

(22) Filed: Apr. 1, 2008

(65) Prior Publication Data

US 2009/0114075 A1 May 7, 2009

(30) Foreign Application Priority Data

Nov. 5, 2007 (DE) ..... 10 2007 054 312

(51) Int. Cl.
*G10D 3/14* (2006.01)

(52) U.S. Cl. ..... 84/305

(58) Field of Classification Search ..... 84/305, 84/304, 306, 274, 267, 297 R
See application file for complete search history.

(56) References Cited

U.S. PATENT DOCUMENTS

| | | | | |
|---|---|---|---|---|
| 1,506,373 A | | 8/1924 | Kremp | |
| 1,604,367 A | | 10/1926 | Page | |
| 1,669,824 A | | 5/1928 | Grover | |
| 1,802,937 A | | 4/1931 | Bertram | |
| 3,726,172 A | * | 4/1973 | Sorkin | 84/304 |
| 4,026,182 A | | 5/1977 | Gilbrech | |
| 4,191,086 A | | 3/1980 | Spercel | |
| 5,767,427 A | | 6/1998 | Corso | |
| 5,998,713 A | * | 12/1999 | Herin | 84/305 |
| 7,102,065 B2 | | 9/2006 | Sperzel | |

FOREIGN PATENT DOCUMENTS

| | | |
|---|---|---|
| DE | 38 28 548 | 3/1990 |
| EP | 1 453 034 | 9/2004 |
| WO | 2007/093371 | 8/2007 |

* cited by examiner

*Primary Examiner*—Jianchun Qin
(74) *Attorney, Agent, or Firm*—Lipsitz & McAllister, LLC

(57) ABSTRACT

A tuning peg for a stringed musical instrument is provided in accordance with the present invention having a shank with a first area which forms a string supporting area and at least one additional area which forms a mounting area for fixing the tuning peg to the stringed musical instrument. The first area is rotatable relative to the at least one additional area. A first gear wheel is connected non-rotatably to the first area. At least one additional gear wheel is connected non-rotatably to the at least one additional area. A head is arranged on the shank so as to be rotatable about an axis of rotation, and at least one drive gear wheel is arranged on the head and acts on the first gear wheel and the at least one additional gear wheel.

40 Claims, 9 Drawing Sheets

TUNING PEG

The present disclosure relates to the subject matter disclosed in German application number 10 2007 054 312.5 of Nov. 5, 2007, which is incorporated herein by reference in its entirety and for all purposes.

BACKGROUND OF THE INVENTION

The invention relates to a tuning peg for a stringed musical instrument.

Strings of a stringed musical instrument are held on the peg box via pegs.

A tuning peg is a peg which makes tuning of a string possible.

Pegs are known from U.S. Pat. No. 1,802,937, U.S. Pat. No. 1,669,824, U.S. Pat. No. 1,604,367, DE 38 28 548 A1, U.S. Pat. No. 1,506,373, U.S. Pat. No. 5,998,713 or EP 1 453 034 A2.

SUMMARY OF THE INVENTION

In accordance with the present invention, a tuning peg (fine tuning peg) is made available which can be fixed to a stringed musical instrument with a minimal effect on it and makes simple tuning possible.

In accordance with an embodiment of the present invention, a shank is provided which has a first area forming a string supporting area and at least one additional area which forms a mounting area for fixing the tuning peg to the stringed musical instrument, wherein the first area is rotatable relative to the at least one additional area, a first gear wheel which is connected non-rotatably to the first area is provided, at least one additional gear wheel which is connected non-rotatably to the at least one additional area is provided, a head which is arranged on the shank so as to be rotatable about an axis of rotation is provided and at least one drive gear wheel which is arranged on the head and which acts on the first gear wheel and the at least one additional gear wheel is provided.

A gear wheel gearing device is made available which comprises the first gear wheel, the at least one additional gear wheel and the at least one drive gear wheel. As a result of a rotary movement of the head, the at least one drive gear wheel can roll on the first gear wheel and the at least one additional gear wheel and thereby bring about a rotation of the first area in relation to the at least one additional area. The tuning peg may be of a compact design as a result of the arrangement of the gear wheel gearing device in the head.

As a result of a different number of teeth for the first gear wheel and the at least one additional gear wheel or for the at least one drive gear wheel, a transmission ratio may be set which allows tuning of the strings.

In addition, the gear wheel gearing device may be designed to be self-locking in a simple manner. As a result, the torque which is exerted on the first area on account of the tension of a string can be absorbed by the gearing device and the first area is prevented from turning back. On the other hand, this results in an optimized tuning capability with a simple operability.

The self-locking design may be achieved, for example, in that the first gear wheel and the additional gear wheel are designed with pitch circles of approximately the same size and the torque exerted on these gear wheels is in opposite directions.

A high transmission ratio may be set as a result of at least two gear wheels being used. For example, a transmission ratio of 7:1 or higher may be achieved in a simple manner in order to be able to effect tuning.

Furthermore, the gear wheel gearing device may be designed such that, as additional area, a second area and a third area are not rotatable relative to one another. As a result, torque which is exerted on the stringed musical instrument as peg torque as a result of the mounting of the tuning peg is kept small. As a result, it is possible, on the other hand, to fix the tuning peg to the stringed musical instrument by way of press fitting without additional connecting aids, such as adhesive and/or form locking elements, needing to be provided.

It is particularly advantageous when the at least one drive gear wheel is arranged at least partially in an interior space of the head. This results in a compact construction. The mechanism of the gear wheel gearing device for rotation of the first area is also protected to the outside as a result.

The at least one drive gear wheel is favorably arranged so as to be offset in relation to the axis of rotation of the head on the shank. As a result of such an eccentric arrangement of the at least one drive gear wheel, the at least one drive gear wheel can be caused to move on an orbital path around the axis of rotation when the head is rotated. As a result, it can roll on the first and the at least one additional gear wheel and cause them to rotate, whereby the first area and the additional area are, on the other hand, rotated relative to one another.

The at least one drive gear wheel is, in particular, rotatable about a drive gear wheel axis of rotation in order to enable it to roll on the first and the at least one additional gear wheel.

It is favorable when the at least one drive gear wheel axis of rotation is oriented parallel to the axis of rotation of the head on the shank. This results in a simple constructional design and the dimensions of the head may be minimized.

In one embodiment, the at least one drive gear wheel is a pinion or comprises a pinion. Such a pinion has, in particular, a smaller external diameter and a smaller pitch circle diameter than the first gear wheel and the at least one additional gear wheel. This results in a compact construction and the dimensions of the head may be kept small. It is, in principle, also possible for the at least one drive gear wheel to be designed as a combination of several gear wheels. Divided gear wheels can, in particular, be provided.

It is, in addition, favorable when the first gear wheel is positioned in an interior space of the head. This results in a compact construction with a simple production capability.

It is likewise favorable when the at least one additional gear wheel is positioned in an interior space of the head. This results in a compact construction.

It is particularly favorable when a gear wheel gearing device which comprises the first gear wheel, the at least one additional gear wheel and the at least one drive gear wheel is positioned in an interior space of the head. As a result, the shank can be designed in a simple manner and, in particular, the diameter of the shank can be kept small and so adaptation to a musical instrument is possible in a simple manner.

The first area and the at least one additional area follow one another on the shank, in particular, in a longitudinal direction parallel to the axis of rotation of the head. This results in optimized dimensions.

It is, in principle, possible for a tuning peg to have only one mounting area and one string supporting area. Such tuning pegs can be used, for example, on plucked instruments, such as guitars, or also on zithers. In one embodiment, a second area and a third area are provided and these form respective mounting areas, wherein a second gear wheel is connected non-rotatably to the second area and a third gear wheel is connected non-rotatably to the third area. As a result, a relative rotatability of the first area not only in relation to the second area but also in relation to the third area may be brought about, wherein the second area and the third area are not rotated relative to one another. As a result, the torque which acts on a musical instrument, to which such a tuning peg is fixed via the second area and the third area, may be minimized.

The first area is then located, in particular, between the second area and the third area, i.e., the string supporting area is located between two spaced mounting areas. As a result, the tuning peg may be fixed to a peg box of a musical instrument over a large mounting surface.

It is favorable when the second area, the first area and the third area follow one another on the shank in a longitudinal direction parallel to the axis of rotation of the head. As a result, the first area may be arranged between mounting areas as a string supporting area.

The first area is favorably connected to a shaft, on which the first gear wheel is arranged. As a result, the first gear wheel may be positioned in spaced relationship to the first area and, in particular, positioned in an interior space of the head.

The shaft is guided through the third area in order to make the connection between the first gear wheel and the first area possible.

It is favorable when the shaft is rotatably mounted on an additional area. As a result, a rotary bearing for the rotatability of the first area relative to the additional area is made available.

The at least one additional gear wheel is favorably arranged coaxially to the first gear wheel.

It is favorable, in addition, when the second gear wheel is arranged in an interior space of the head in order to protect it and make a compact design with a simple production capability possible.

It may be provided for the second gear wheel to be arranged on a pin element which is guided through the first area and the third area. As a result, the second gear wheel can be positioned on and, in particular, in the head in spaced relationship to the second area. As a result, it is possible, on the other hand, to position the first gear wheel and the second gear wheel on the head in immediate vicinity to one another and so the at least one pinion can act on the first gear wheel and on the second gear wheel at the same time.

In this respect, it may be provided for the first pin element to be rotatably mounted on the first area in order to make a relative rotatability between the first area and the second area possible in a simple way.

For the same reason, it is favorable when the pin element is rotatably mounted on a shaft, on which the first gear wheel is arranged.

It is particularly advantageous when the third area is connected non-rotatably to the third gear wheel. As a result, a relative rotatability of the first area relative to the second area and the third area can be made possible in a simple manner, wherein the second and the third areas are not rotated relative to one another.

The third gear wheel is, in particular, arranged coaxially to the first gear wheel in order to make rotatability of the first area possible.

Furthermore, it is favorable when the at least one pinion acts on the third gear wheel in order to make rotatability of the first area relative to the third area possible.

In addition, it is favorable when the third gear wheel is arranged in an interior space of the head. As a result, it may be positioned at the operative area of the at least one drive gear wheel and thereby be positioned in a protected manner. This results in a compact construction with a simple production capability.

It is favorable when the first gear wheel is arranged between the second gear wheel which is connected non-rotatably to the second area and the third gear wheel which is connected non-rotatably to the third area. This results in a simple and compact construction. For example, the third gear wheel may be formed in one piece with the third area.

It is particularly advantageous when the first gear wheel and the at least one additional gear wheel have a different number of teeth and/or the at least one drive gear wheel which acts on the first gear wheel and the second gear wheel with a different number of teeth. As a result, a transmission may be achieved which causes the first area to turn relative to the second area in a small angular step in comparison with the rotation of the head on the shank. As a result, tuning is possible. A transmission for the tuning may be achieved as a result of a different "relative number of teeth" between the first gear wheel and the at least one additional gear wheel. This different "relative number of teeth" may be realized in that the first gear wheel and the second gear wheel have a different number of teeth. Furthermore, it is possible to realize this difference in that the at least one drive gear wheel acts on the first gear wheel and on the at least one additional gear wheel with a different number of teeth. This different number of teeth on the at least one drive gear wheel may be realized, for example, in that it is designed in several parts with a first gear subwheel with acts on the first gear wheel and with a second gear subwheel which acts on the at least one additional gear wheel, wherein the first gear subwheel and the second gear subwheel have a different number of teeth. It is also possible for a combination consisting of at least two drive gear wheels to be used, wherein gear wheels with different numbers of teeth are provided in this combination. The two possibilities can also be combined, i.e., not only the first gear wheel but also the at least one additional gear wheel have a different number of teeth and also the at least one drive gear wheel acts on the first gear wheel and on the at least one additional gear wheel with a different number of teeth.

In one embodiment, the first gear wheel has a greater number of teeth than the at least one additional gear wheel. When the first gear wheel has a smaller number of teeth, the first area turns in an opposite direction during rotation of the head about the shank. With a greater number of teeth, the first area turns in the same direction with the rotation of the head about the shank. This makes tuning easier for a user.

It is particularly advantageous when the second gear wheel which is connected non-rotatably to the second area and the third gear wheel which is connected non-rotatably to the third area have the same number of teeth. As a result, it is possible in a simple manner for the second gear wheel and the third gear wheel not to rotate relative to one another during rolling movement of the at least one pinion on these gear wheels. As a result, the wear and tear on a peg box can be kept small; the second area and the third area are seated in the bow in the peg box and act, in principle, on it. When they are not turned relative to one another, the torque exerted is also minimized. As a result, it is also possible, on the other hand, to fix the corresponding tuning peg to the peg box simply by way of press fitting.

It is particularly advantageous when the first gear wheel has a different number of teeth in comparison with the second gear wheel and/or the third gear wheel. As a result, a defined transmission ratio may be achieved which is greater than one. As a result, it is, for example, possible, on the other hand, to alter string lengths in the order of magnitude of 0.01 mm or less when the transmission ratio is set accordingly. This results in great precision during tuning.

The number of teeth of the first gear wheel and/or the number of teeth, with which the at least one drive gear wheel acts on the first gear wheel, advantageously differs by m+i from the number of teeth of the at least one additional gear wheel and/or the number of teeth, with which the at least one drive gear wheel acts on the at least one additional gear wheel, wherein m is a natural number and i is the number of drive gear wheels which act on the first gear wheel and the at least one additional gear wheel and which are spaced transversely to the axis of rotation. This results in a gearing device, the transmission ratio of which (greater than one) may be set accordingly and which is self-locking. As a result of the at least one drive gear wheel rolling on the first gear wheel, a second gear wheel and, where applicable, a third gear wheel, the first area is turned in accordance with the transmission ratio set. As a result of rotation of the head relative to the shank, the at least one drive gear wheel rolls on the gear wheels.

The at least one drive gear wheel is favorably of a height which is at least as great as the overall height of a combination consisting of first gear wheel and at least one additional gear wheel. As a result, the at least one drive gear wheel can roll simultaneously on the first gear wheel and the at least one additional gear wheel and, as a result, make a relative movement of the first area in relation to the at least one additional area possible.

It is favorable when a plurality of drive gear wheels are present which are arranged so as to be evenly distributed on the head in relation to the axis of rotation of the head on the shank. As a result, it may be ensured that at least two teeth of the drive gear wheels always engage in the gear wheels which are associated with the first area and the at least one additional area. This results in a uniform rotary movement of the first area in order to make an optimized tuning possible. In principle, more than two drive gear wheels may be present; the more drive gear wheels, the more uniform the rotary movement. However, the space requirements are also greater as a result. When i drive gear wheels are present, their axes of rotation should be arranged so as to be spaced through an angle of 360°/i in relation to the axis of rotation of the head on the shank. In one advantageous embodiment, two drive gear wheels are present; as a result, an optimized compromise is achieved between space requirements in the head and homogeneity of the rotary movement of the first area.

In one embodiment, an end of the tuning peg facing away from the head is formed on the at least one additional area. The at least one additional area is an outer area and, as a result, can also, in principle, be machined.

The at least one additional area advantageously has an area which can be cut to length. As a result, the length of the tuning peg can be adapted to a stringed musical instrument. The area of a tuning peg which projects beyond the peg box can, in particular, be shortened.

In an alternative embodiment, an end of the tuning peg facing away from the head is formed on the first area. A string supporting area forms, as a result, an end area of the tuning peg.

It is particularly advantageous when a gear wheel gearing device for the rotation of the first area about the first gear wheel by means of the at least one pinion is designed to be self-locking. A tensioned string which is held at the first area exerts torque on the first area, in principle, via the tensioning; this can cause a backward rotation. As a result of a self-locking design of the gear wheel gearing device, this is prevented. As a result, an optimized tuning can, on the other hand, be achieved.

A self-locking gear wheel gearing device may be realized in a simple manner when the first gear wheel and the at least one additional gear wheel have at least approximately the same pitch circle diameter. When, for example, diametrically spaced pinions are present as drive gear wheels, the torque may be applied to the first gear wheel and the at least one additional gear wheel in opposite directions. As a result, the torques applied to the pinions cancel one another out.

The at least one drive gear wheel favorably moves orbitally about the axis of rotation of the head on the shank as a result of rotation of the head. As a result, the at least one drive gear wheel can roll on the first gear wheel and the at least one additional gear wheel (and, where applicable, on the second gear wheel and third gear wheel) in order to cause the first area to rotate.

It is favorable when the at least one drive gear wheel rolls on the first gear wheel and the at least one additional gear wheel (where applicable, a second gear wheel and third gear wheel) as a result of rotation of the head. As a result, rotation of the first area can be brought about in a simple manner, wherein this rotation is initiated by rotation of the head. By providing a second gear wheel and third gear wheel which are connected non-rotatably to a second area and to a third area, respectively, a transmission ratio may be set which brings about a slower rotation of the first area.

The head favorably has at least one finger gripping surface for the easy operability of the rotary movement relative to the shank.

The following description of preferred embodiments serves to explain the invention in greater detail in conjunction with the drawings.

DETAILED DESCRIPTION OF THE INVENTION

Figure 1:
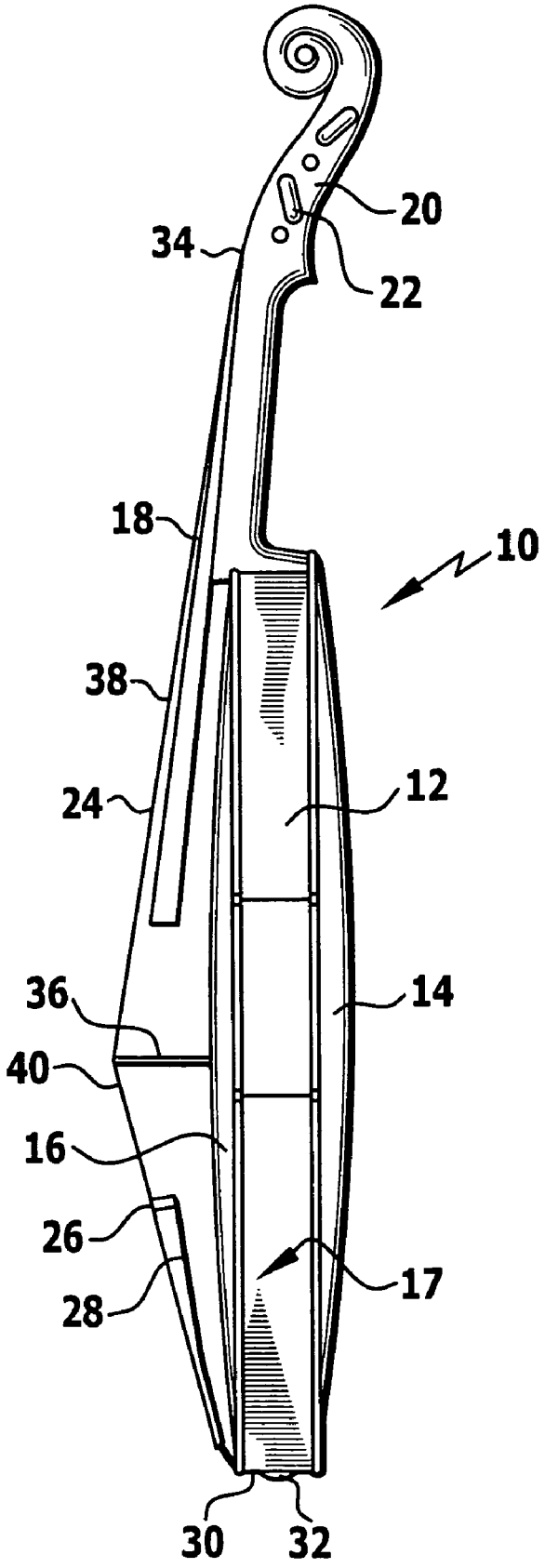
FIG. 1 shows a side view of a violin as example of a stringed musical instrument.
Figure 2:
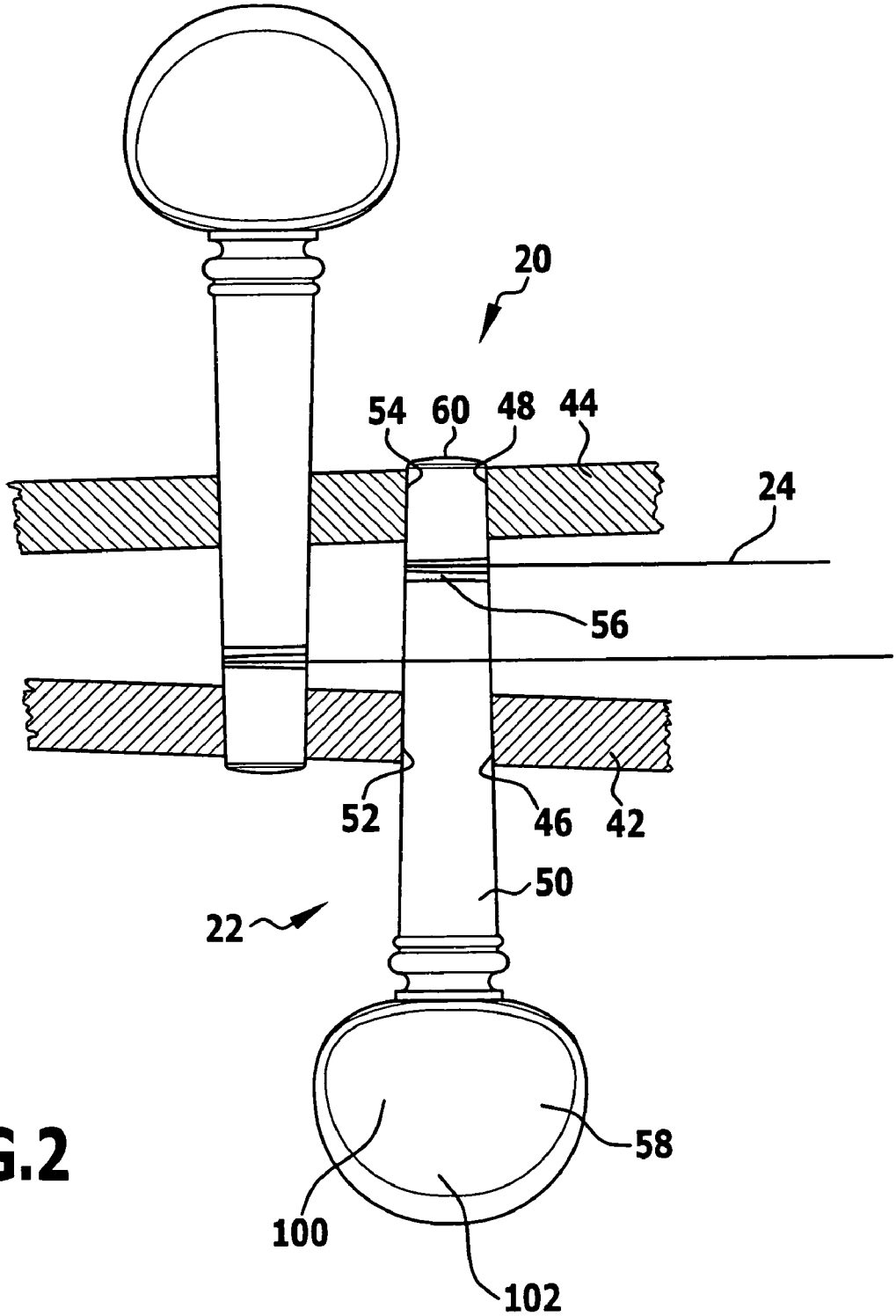
FIG. 2 shows a schematic illustration of a peg box of a stringed musical instrument, on which tuning pegs are arranged.

A violin 10 as example of a (bowed) stringed musical instrument has, as shown in FIG. 1, a rib 12 with a back 14 and a top 16 which form a body 17. A fingerboard 18 is arranged on the rib 12 and a peg box 20 is seated on the fingerboard. The peg box 20 is produced from wood, such as, for example, maple. Pegs 22, via which strings 24 may be fixed to the peg box 20 at one end of the string, are arranged on the peg box 20.

At their other end 26, the strings 24 are fixed to a tailpiece 28. This tailpiece 28 has a tail gut 30 which forms a tail gut bow. The tail gut bow is attached to an end button 32 in order to hold the tailpiece 28 in place.

If the end 26 of a string 24 is secured via the tailpiece 28 relative to the rib 12, the tension on the string 24 may be altered via the associated peg 22 and the string may be tuned, as a result.

That part of the string 24 which is located between a nut 34 on the fingerboard 18 and a bridge 36 arranged on the top 16 is designated as primary string 38. That part of the string 24 which is located between the bridge 36 and the tailpiece 28 is designated as secondary string 40.

The peg box 20 comprises a first strip 42 consisting of wood and a second strip 44 of wood spaced therefrom. The strings 24 of the stringed musical instrument 10 are guided between the first strip 42 and the second strip 44. In order to fix a peg 22 in place, corresponding bores 46 are arranged in the first strip 42 and bores 48 in the second strip 44. A pair of bores consisting of a first bore 46 and a second bore 48 oriented in alignment therewith is associated with the peg 22.

The first bores 46 and the second bores 48 are respectively designed to be rotationally symmetric; the corresponding axes of symmetry of the associated bores of one pair are coaxial with their axis of symmetry. The diameter of the bores 46 and 48 can be adapted to the diameter of a shank 50 of a peg 22 with a peg reamer.

A peg 22 has a first mounting area 52, with which it is held on the first strip 42, and a second mounting area 54 which is spaced thereto and with which it is held on the second strip 44. A string supporting area 56 which supports a string 24 is arranged between the first mounting area 52 and the second mounting area 54.

One end 60 of the shank and of the peg 22 is located opposite the head 58.

Figure 3:
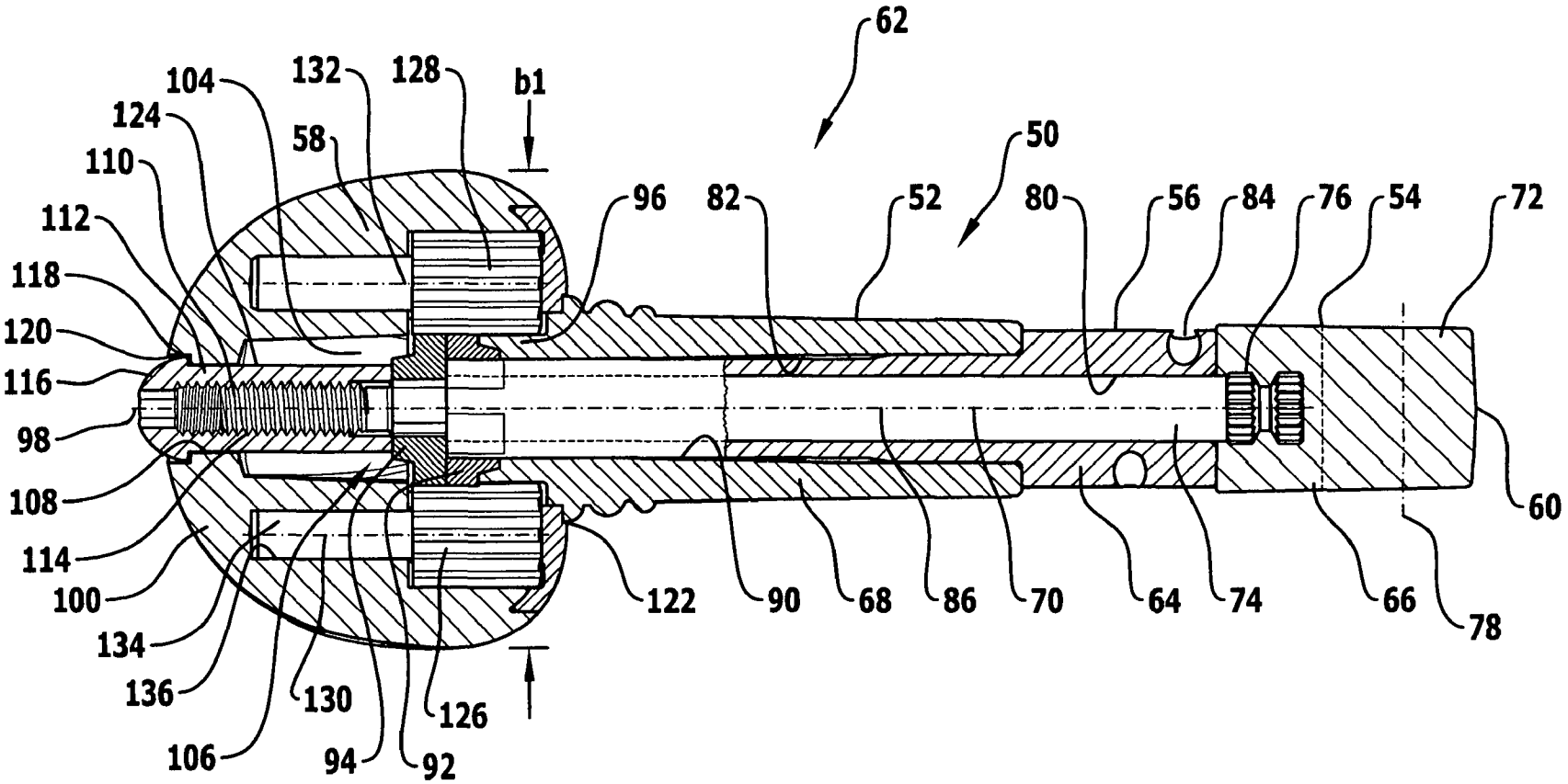
FIG. 3 shows a sectional view of one embodiment of a tuning peg according to the invention.
Figure 4:
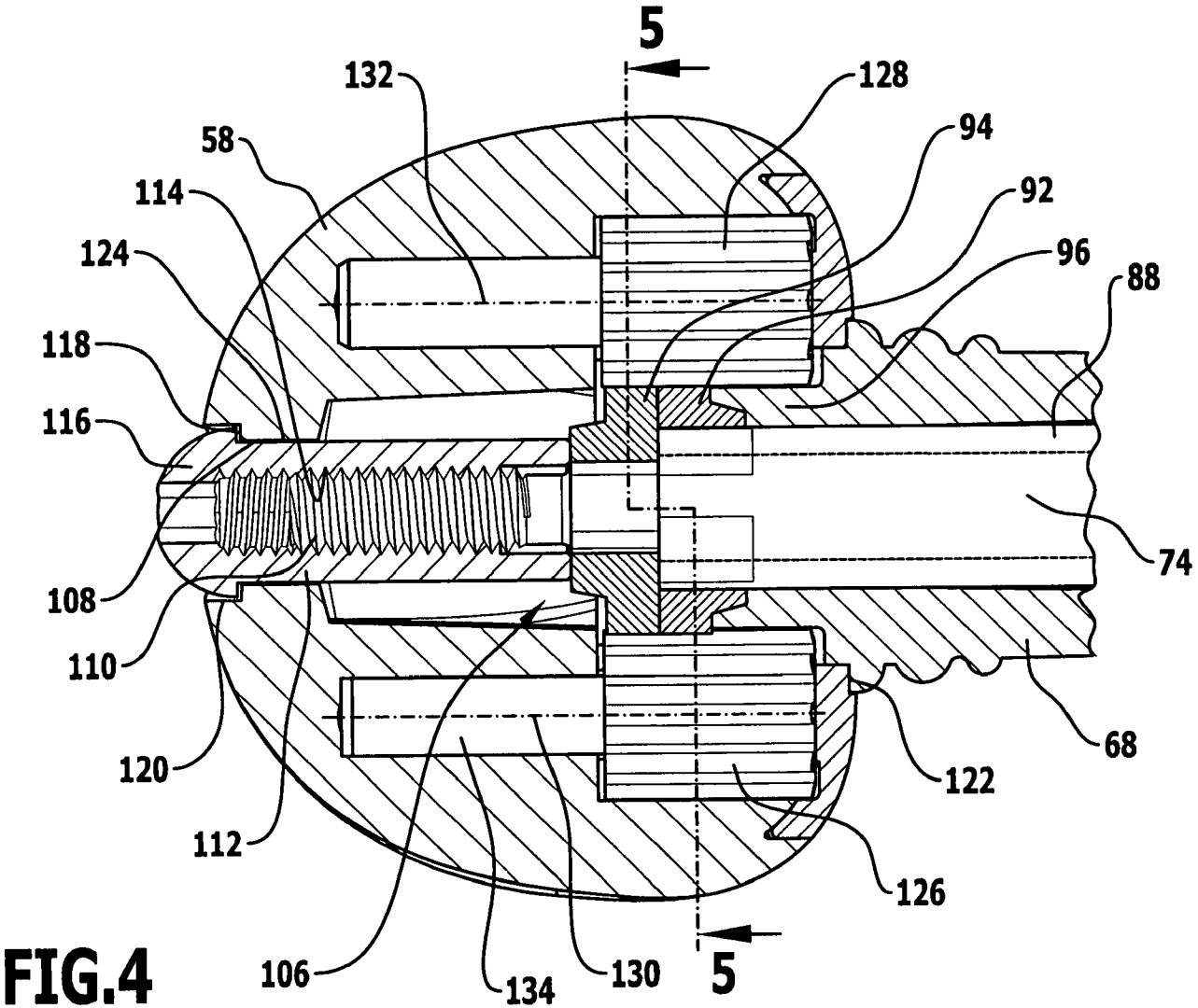
FIG. 4 shows an enlarged illustration of a head of the tuning peg according to FIG. 3.
Figure 5:
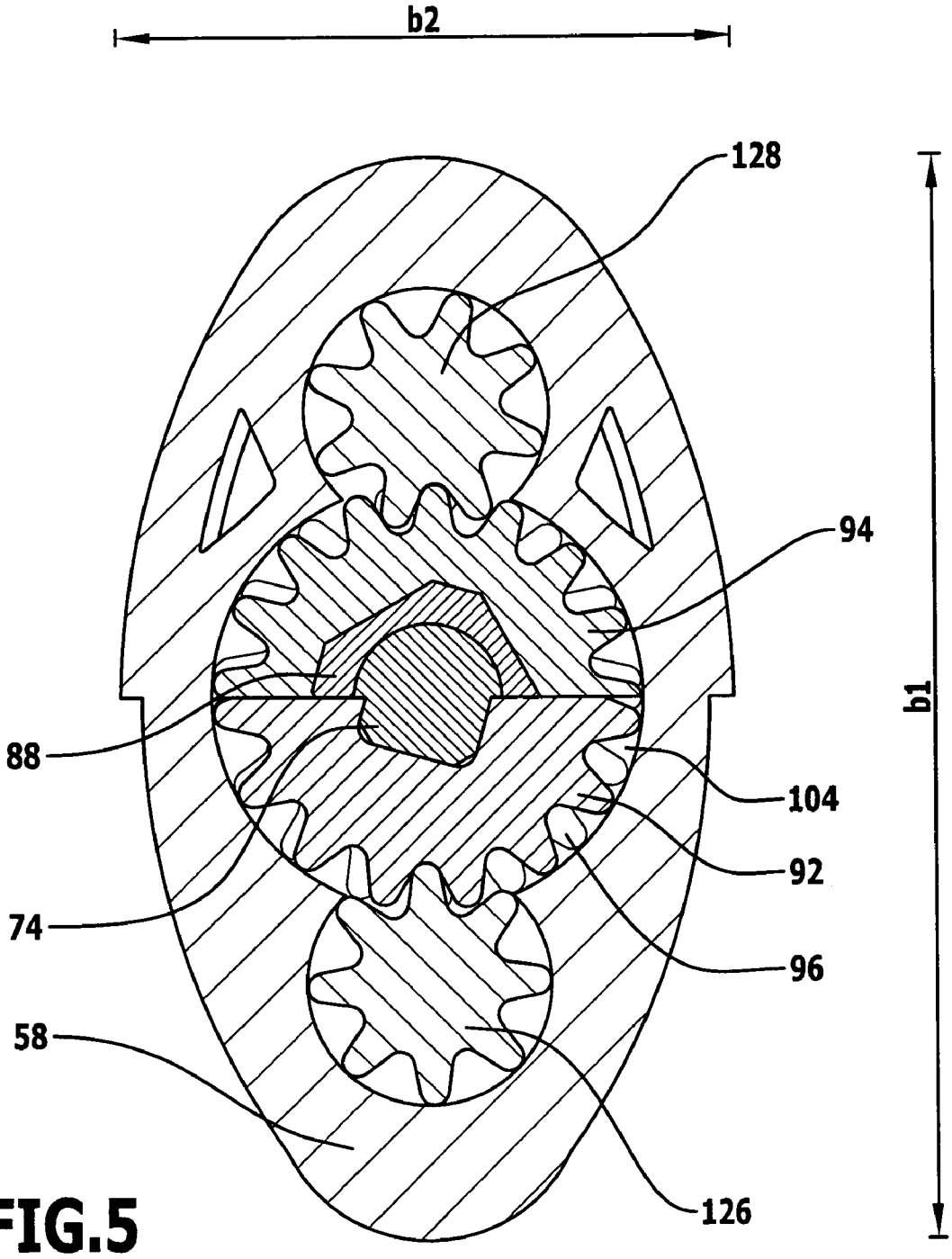
FIG. 5 shows a sectional view along line 5-5 according to FIG. 4.
Figure 6:
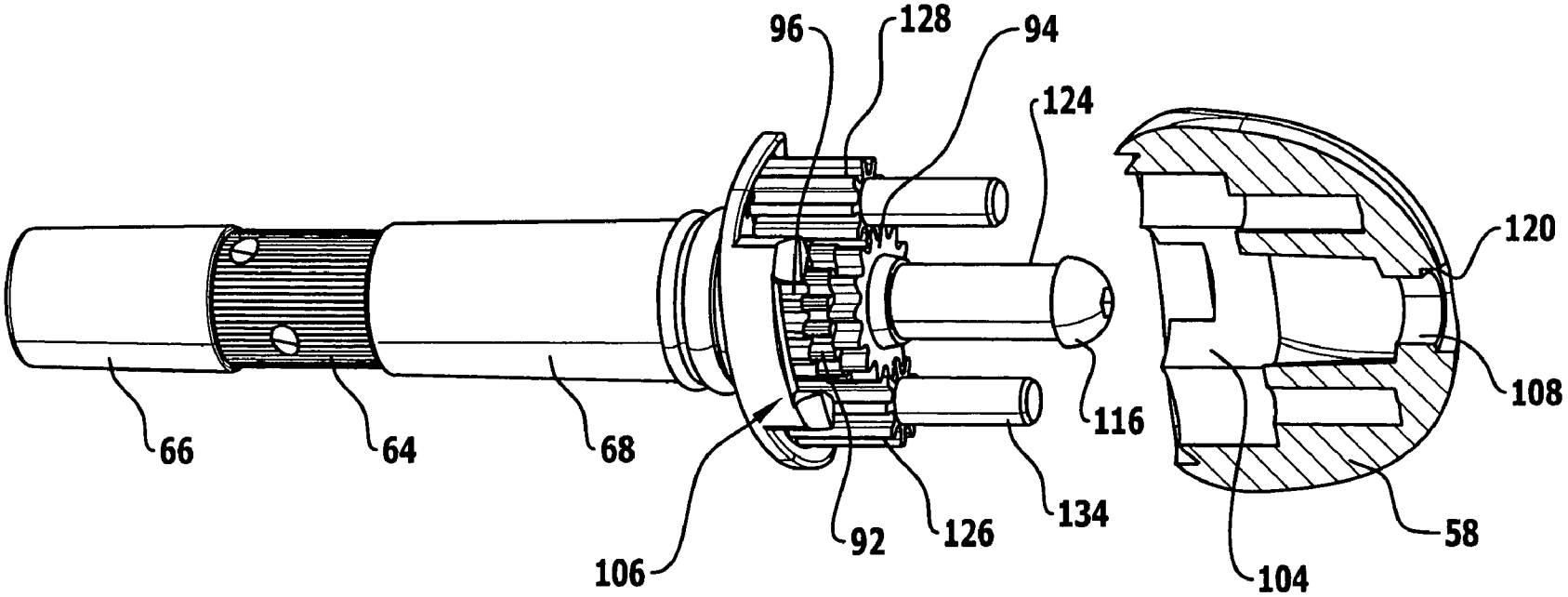
FIG. 6 shows a perspective exploded illustration of the tuning peg according to FIG. 3 with a head in a sectional view.

A peg according to the invention is designed as a tuning peg and, in particular, as fine tuning peg. One embodiment is shown in FIG. 3 and designated as 62.

The shank 50 of the tuning peg 62 comprises a first area 64 which is designed as a string supporting area 56 (string holding area). It further comprises a second area 66 which is designed as a second mounting area 54 and a third area 68 which is designed as a first mounting area 52.

The second area 66, the first area 64 and the third area 68 follow one another in a linear manner. They are essentially designed to be rotationally symmetric to an axis 70 and are coaxial to this axis 70. The end 60 is formed on the second area 66.

The second area 66 is produced from a solid material, at least in one section 72. This solid material is, for example, a metallic material, such as aluminum, a plastic material or a wood material. A pin element 74 which extends along the axis 70 is held non-rotatably at the second area 66. The pin element 74 is held on the second area 66 via a form locking connection 76 or a press fitting connection.

The second area is, for example, of a truncated design at least in one section.

The second area 66 can be shortened outside the connection area to the pin element 74. This is indicated in FIG. 3 by a cutting plane 78. As a result, the tuning peg 62 may be adapted to the peg box 20 of a stringed musical instrument 10; the area of the tuning peg 22 projecting beyond the second strip 44 can be shortened. The length of the tuning peg 62 can, as a result, be adapted individually to a stringed musical instrument.

The pin element 74 is produced, for example, from a metallic material, such as, for example, aluminum, steel, brass etc. It is guided through an interior space 80 of the first area. Furthermore, it is guided through an interior space 82 of the third area 68.

The first area 64, which follows the second area 66, is produced, for example, from a metallic material, such as, for example, aluminum, steel, brass etc. It has one or more insertion holes 84 for a string 24. The first area 64 is rotatable about an axis of rotation 86 relative to the second area 66. The axis of rotation 86 coincides with the axis 70.

The first area 64 is also designated as a spool since an end area of a string 24 can be wound onto it in a spool-like manner.

A shaft 88 is held non-rotatably at the first area 64. The shaft 88 can, in this respect, be connected to the first area 64 in one piece or it can be fixed to it afterwards. The shaft 88 is guided through the interior space 82 of the third area 68. The first area 64 is rotatable about the axis of rotation 86 relative to the third area 68. The first area 64 is rotatably mounted on the third area 68 via the shaft 88.

The shaft 88 has an interior space 90, through which the pin element 74, which is connected non-rotatably to the second area 66, is guided.

A first gear wheel 92 is seated non-rotatably on the shaft 88 at or in the vicinity of an end facing away from the first area 64. This gear wheel is, as a result, connected to the first area 64 non-rotatably and spaced in relation to it (via the shaft 88). The first gear wheel 92 is arranged coaxially to the axis of rotation 86.

The first gear wheel 92 is produced, for example, from a metallic material, such as aluminum or stainless steel.

The first gear wheel 92 has a number $n_1$ of teeth distributed uniformly around the axis of rotation 86.

A second gear wheel 94 is seated on the pin element 74 at or in the vicinity of an end facing away from the second area 66. The second gear wheel 94 is connected non-rotatably to the pin element 74 and is, as a result, connected non-rotatably to the second area 66 and spaced in relation to it (via the pin element 74).

The second gear wheel 94 is arranged coaxially to the axis of rotation 86. It has a number $n_2$ of teeth distributed uniformly around the axis of rotation 86.

The external diameter of the first gear wheel 92 and the external diameter of the second gear wheel 94 are essentially the same. The first gear wheel 92 and the second gear wheel 94 are adjacent to one another. In this respect, a small distance may lie between them or they can abut on one another, wherein a relative rotation of the first gear wheel 92 and the second gear wheel 94 is made possible. For example, the second gear wheel 94 is an outer gear wheel which is at a greater distance to the end 60 in comparison with the first gear wheel 92.

A third gear wheel 96 is seated non-rotatably on the third area 68. This third gear wheel 96 is positioned in a region of the third area 68 which is located at or in the vicinity of an end which faces away from the end which points towards the first area 64. The third gear wheel 96 can be formed in one piece on the third area 68 or it can be a separate element which is positioned on the third area 68 afterwards.

The third area 68 is of a truncated design, at least in one section.

The third gear wheel 96 is coaxial to the axis of rotation 86. It has a number $n_3$ of teeth distributed uniformly around the axis of rotation 86. The third gear wheel 96 follows the first gear wheel 92, i.e., the third gear wheel 96 is that gear wheel which is located closest to the end 60 in the series of gear wheels 92, 94, 96.

The gear wheel 96 has essentially the same external diameter as the first gear wheel 92 and the second gear wheel 94. The gear wheels 92, 94, 96 are designed, for example, as spur gears.

The head 58 is arranged on the shank 50 for rotation about an axis of rotation 98. The axis of rotation 98 coincides with the axis of rotation 86 of the gear wheels 92, 94, 96. The head 58 is also designated as a knob.

Figure 7:
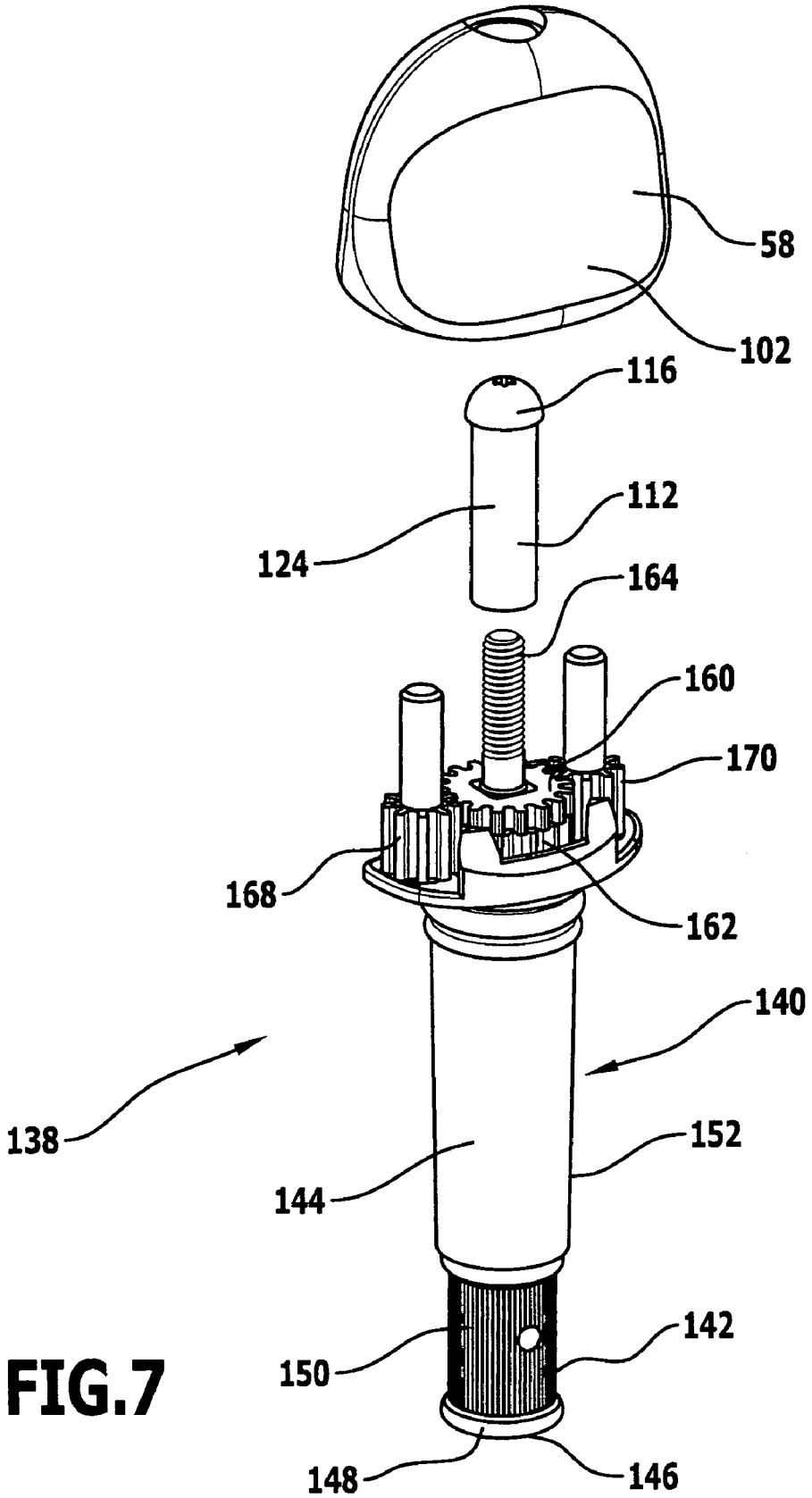
FIG. 7 shows a perspective exploded illustration of a second embodiment of a tuning peg according to the invention.

The head 58 has a gripping part 100, via which a user can bring about rotation. The gripping part 100 is designed, for example, so as to be in mirror symmetry to a plane which is parallel to the plane of drawing of FIG. 3. It has a first width $b_1$ in a first direction at right angles to the axis of rotation 98 and a second width $b_2$ in a direction at right angles thereto and to the axis of rotation 98 (FIGS. 3, 7). The width $b_2$ is smaller than the width $b_1$. The gripping part 100 is designed, for example, in the shape of a mushroom with finger gripping surfaces 102 on opposite sides.

The gripping part 100 and, with it, the head 58 has an interior space 104, in which a gear wheel gearing device 106 is arranged, via which a rotary movement of the head 58 can be transferred to the first area 64 of the shank 50. The gear wheels 92, 94, 96 are part of this gear wheel gearing device 106.

The gripping part 100 has a central opening 108 which is located coaxially around the axis of rotation 98. An externally threaded element 110 is seated non-rotatably on the shank 50. This element is arranged coaxially to the axis 70. The externally threaded element 110 engages in the opening 108 of the gripping part 100. A pin 112 with an internal thread 114 is screwed onto the externally threaded element 110. The pin 112 has a head 116 which, when the pin 112 is screwed in, abuts on a base 118 of a recess 120 in the gripping part 100. The recess 120 thereby forms an enlargement of the opening 108 towards an upper side of the gripping part 100. Any axial lifting of the head 58 away from the third area 68 of the shank 50 is blocked via the head 116.

The head 58 has, in addition, a contact area 122 which faces the third area 68 of the shank 50 and is, for example, of an annular design. This contact area 122 forms a blocking surface for the movement of the head 58 towards the third area 68.

The pin 112 has a cylindrical area 124 which forms a rotary bearing pin (external shaft) for the rotatability of the head 58 relative to the shank 50.

A first pinion 126 and a second pinion 128 are arranged in the interior space 104 of the head 58 as drive gear wheels. These drive gear wheels 126, 128 are designed, for example, as spur gears. They are rotatable about a first drive gear wheel axis of rotation 130 and about a second drive gear wheel axis of rotation 132, respectively. The drive gear wheel axes of rotation 130 and 132 are located parallel to the axis of rotation 98 of the head 58 relative to the shank 50 and are respectively offset to it, i.e., are in spaced parallel relationship to it. The first pinion 126 (first drive gear wheel 126) and the second pinion 128 (second drive gear wheel 128) are, as a result, arranged eccentrically to the rotary mounting of the head 58 in the shank 50.

The rotatability of the first pinion 126 and the second pinion 128 is respectively realized by a pin 134 which is, in particular, of a cylindrical design and is formed in a cylindrical recess 136 in the interior space 104 of the head 58. The respective pin 134 of the first pinion 126 and the second pinion 128 is connected non-rotatably to it.

The first pinion 126 and the second pinion 128 are located opposite one another in a width direction at right angles to the axis 70, each with the same distance to the axis of rotation 98; they are, as a result, arranged so as to be distributed uniformly around the axis of rotation 98.

The series of gear wheels with the first gear wheel 92, the second gear wheel 94 and the third gear wheel 96 is located between the first pinion 126 and the second pinion 128. Both the first pinion 126 and the second pinion 128 engage in the gear wheels 92, 94, 96. The pinions 126 and 128 are part of the gear wheel gearing device 106.

The first pinion 126 and the second pinion 128 are caused to move orbitally around the axis of rotation 98 as a result of a rotary movement of the head 58 about the axis of rotation 98 relative to the shank 50. The first pinion 126 and the second pinion 128 roll on the first gear wheel 92, the second gear wheel 94 and the third gear wheel 96 and cause them to move in a corresponding rotary movement, as will be explained below in greater detail. As a result of the gear wheel gearing device 106, the rotary movement is transferred to the first area 64 in order to be able to bring about tuning of a string 24.

The number of teeth $n_2$ of the second gear wheel 94 and the number of teeth $n_3$ of the third gear wheel 96 is the same ($n_2=n_3$). The number of teeth of the first gear wheel 92 differs therefrom, i.e., $n_1 \neq n_2, n_3$. The number of teeth $n_1$ of the first gear wheel 94 can, in this respect, be greater than or smaller than $n_2$, $n_3$. When the number of teeth $n_1$ is greater than $n_2$, $n_3$, the direction of rotation of the head 58 about the axis of rotation 98 and the direction of rotation of the first area 64 about the axis of rotation 96 are the same. When the number of teeth $n_1$ is smaller than $n_2$, $n_3$, the direction of rotation of the head 58 relative to the shank 50 and the direction of rotation of the first area 64 about the axis of rotation 86 are opposite to one another.

The transmission of the gear wheel gearing device 106 is determined by the number of teeth. This results as $$\frac{n_1}{n_1 - n_2} : 1 \tag{1}$$

In one embodiment, $n_1$ is 17 and $n_2$, $n_3$ are 15. The transmission then results as 8.5:1, i.e., with 8.5 revolutions of the head 58 about the shank 50, the first area 64 rotates once (through 360°) about the axis of rotation 86.

In the case of the embodiment described above, the gear wheel gearing device 106 comprises two pinions as drive gear wheels, namely the first pinion 126 and the second pinion 128. The pinions 126 and 128 have, in particular, a smaller (external) diameter than the gear wheels 92, 94, 96 and also a smaller pitch circle diameter than them.

It is also possible for only one pinion to be provided as drive gear wheel or for more than two pinions to be provided. When i pinions, which are arranged with their axes of rotation so as to be offset in relation to the axis of rotation 98, are present, the number of teeth of the first gear wheel 92 must differ by m+i from the number of teeth $n_2$, $n_3$, wherein m is a natural number. In the case where two pinions (i=2) are present, the first gear wheel 92 must, therefore, comprise 2, 4, 6 etc. more teeth or correspondingly less teeth than the second gear wheel 94 and the third gear wheel 96.

It is, in principle, also possible for the pinions to act only on the first gear wheel 92 in order to rotate the first area 64 and for the second gear wheel 94 and the third gear wheel 96 to not be present.

As a result of the solution according to the invention, the tuning of a string 24 is possible as a result of rotation of the head 58 relative to the shank 50, this string being held on the first area 64 (string supporting area 56). The shank 50 does not rotate outside the first area 64 and so no wear and tear on the bores 46 and 48 in the peg box 20 as a result of rotation of the head 58 relative to the shank 50 occurs.

It has been shown that as a result of the solution according to the invention string lengths may be altered in steps of 0.01 mm or less. This results in great precision during tuning. When, for example, the gear wheel gearing device 106 has a transmission ratio of 8.5:1, a change in the string length of 2.59 mm during a full rotation through 360° results with a diameter of the first area 64 of 7 mm which is a typical diameter (with a resulting string length of 22 mm at the first area 64). The rotatability can be metered in steps of approximately 1° and so the above-mentioned tuning capability of length changes of approximately 0.01 mm per string 24 results.

The gear wheel gearing device 106 is designed to be self-locking. The string 24 exerts torque on the first area 64 on account of the string tension. As a result of the self-locking design of the gear wheel gearing device 106, the set rotary position of the first area 64 is maintained, i.e., the string 24 cannot turn the first area 64 back. The shank 50 with its mounting areas 52, 54 need not make any contribution to the "braking" of the return rotation of the first area 64. As a result, it is possible, on the other hand, to press the shank 50 with the second area 66 and 68 securely into the bores 46 and 48 and fix it in place in this manner without any additional fixing being necessary apart from the press fitting. In particular, no additional adhesion or any additional form locking need be provided. As a result, the action on the stringed musical instrument for fixing the tuning peg 62 in place is minimized.

The gear wheels 92, 94, 96 have at least approximately the same pitch circle diameter (working diameter). The torques exerted on the respective gear wheels 92, 94, 96 are in opposite directions. As a result of the pitch circle diameters of these gear wheels 92, 94, 96 which are at least approximately of the same size, the torques acting on the pinions 126, 128 cancel each other out and the gear wheel gearing device 106 is self-locking.

As already mentioned above, a projecting end of the tuning peg 62 can be shortened in a simple manner by cutting to length (shortening the second area 66) and, therefore, be adapted to the peg box 20.

As likewise mentioned above, it is, in principle, possible for the gear wheel gearing device 106 to comprise only one pinion. When more than one pinion is present, several pinion teeth can be in engagement and the load can be distributed over at least two teeth. As a result, a more even transfer of the rotary movement of the head 58 to the second area 64 can be achieved. When several pinions are present, they should be arranged so as to be uniformly distributed in relation to the axis of rotation 98.

The provision of two pinions 126, 128 is ideal to the extent that the space requirements in the head 58 can be kept small; when more than two pinions are present, the head 58 must be of a correspondingly larger design.

The tuning peg 62 according to the invention may, in principle, be used with all types of stringed musical instruments and, in particular, with bowed string instruments and plucked instruments when the dimensions are adapted accordingly.

As a result of the fact that the second gear wheel 94 and the third gear wheel 96 have the same number of teeth and the first gear wheel 92 has a number of teeth differing therefrom, no relative rotation occurs between the second area 66 and the third area 68; the first area 64 is, however, rotatable relative to the second area 66 and is rotatable relative to the third area 68. As a result, the second area 66 and the third area 68 experience a minimized torque when they are arranged in the respective bores 48, 46 in the peg box 20.

Combinations of several gear wheels can also be used as drive gear wheels for driving the gear wheels 92, 94, 96.

It is, in principle, possible alternatively or in addition for a drive gear wheel to act on the first gear wheel 92 and the second gear 94 or the third gear wheel 96 with a different number of teeth. In this case, the gear wheels 92 and 94 or 92 and 96 have the same number of teeth since the transmission is provided by the different number of teeth of the corresponding drive gear wheel (pinion).

For this purpose, the drive gear wheel is, for example, designed such that it has different sections with different numbers of teeth in the direction of the axis of rotation 98. Each section rolls, in this respect, on a respective gear wheel 92, 94 and 96.

It is also possible for a series of drive gear wheels, which are connected non-rotatably to one another and which have different numbers of teeth, to be used instead of one drive gear wheel. In particular, that drive gear wheel in the series which engages the first gear wheel 92 has a different number of teeth to the additional drive gear wheels in the series which engage the second gear wheel 94 and the third gear wheel 96.

A transmission for the purpose of tuning may be brought about when a difference in the "relative number of teeth" for the first gear wheel 92 in comparison with the second gear wheel 94 and the third gear wheel 96 is present. This difference in the "relative number of teeth" may be brought about by different numbers of teeth between the first gear wheel 92 and the second gear wheel 94 or the third gear wheel 96 and/or by a different number of teeth on that part of a drive gear wheel or series of drive gear wheels which acts on the first gear wheel 92 and the second gear wheel 94 or the third gear wheel 96.

Figure 8:
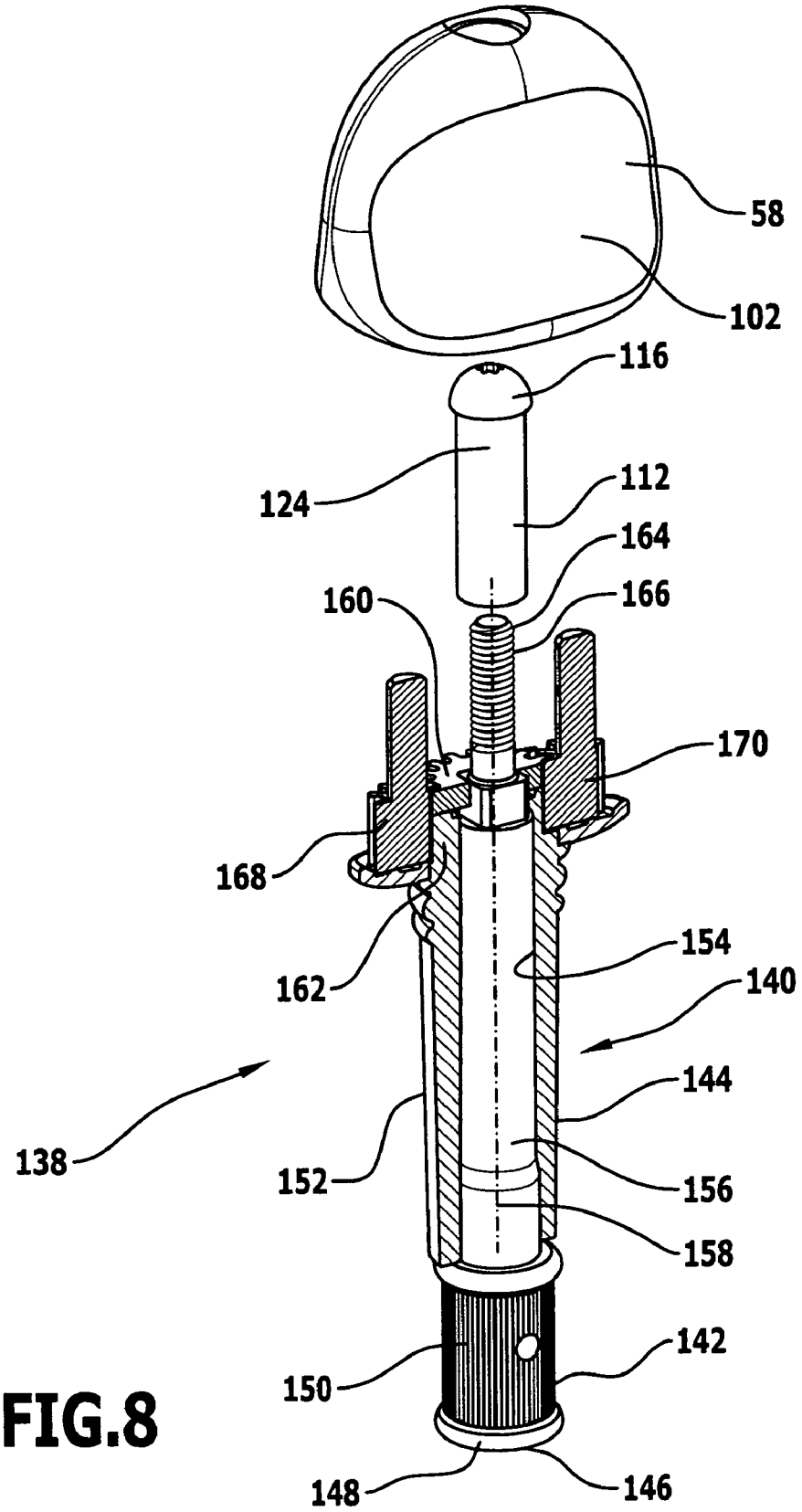
FIG. 8 shows a partial sectional illustration of the tuning peg according to FIG. 7.

A second embodiment of a tuning peg according to the invention, which is shown in FIGS. 7 and 8 and designated in this case as 138, comprises a shank 140 with a first area 142 which is a string supporting area and a second area 144 which is a mounting area. A front end 146 of the tuning peg 138 is formed on the first area 142. A ring element 148 is arranged at the first area 142 in the region of the end 146 and this protrudes beyond a surface 150 of the first area 142. This ring element 148 serves to prevent an area of a string held on the string supporting area 142 from slipping off.

The ring element 148 is formed, for example, via a disk element which is arranged at the end of the shank 140.

The second area 144 has, for example, a conically extending surface 152.

A shaft 156 is guided through an interior space 154 of the second area 144 and is connected non-rotatably to the first area 142. The shaft 156 is of a cylindrical design. The interior space 154 is of a hollow cylindrical design. The shaft 156 is mounted in the interior space 154 for rotation about an axis of rotation 158.

A first gear wheel 160 is seated non-rotatably on the shaft 156 above the second area 144. The first gear wheel 160 is positioned coaxially to the axis of rotation 158.

A second gear wheel 162 is seated on the second area 144 directly beneath the first gear wheel 160. The second gear wheel 162 is arranged so as to be rotatable about the axis of rotation 158 and coaxial to the first gear wheel 160.

The second gear wheel 162 is, for example, formed in one piece on the second area 144.

A head is positioned for rotation on the shaft 156. This head is, in principle, of the same design as the head 58 of the tuning peg 62. For this reason, the same reference numeral is used.

A pin element 164 with an external thread 166 is seated on the shaft 156 above the first gear wheel 160 and is aligned coaxially to the axis of rotation 158. A pin corresponding to the pin 112 with a cylindrical area 124 is screwed onto this external thread. The head 158 is rotatable about this pin 112 which forms an external shaft.

A first pinion 168 and a second pinion 170 are seated in the interior space 104 of the head 58 as drive gear wheels. The pinions 168, 170 have the same function as the pinions 126 and 128 of the tuning peg 62. They can move orbitally as a result of rotation of the head 58. They act on the first gear wheel 160 and the second gear wheel 162.

The first gear wheel 160 is designed, in particular, as a spur gear. It has a number of teeth $n_1$. The second gear wheel 162 is likewise preferably designed as a spur gear. It has a number of teeth $n_2$. In this respect, the number of teeth $n_1$ of the first gear wheel 160 is greater than the number of teeth $n_2$ of the second gear wheel 162. During rotation of the head 58, the first gear wheel 160 and the second gear wheel 162 are caused to rotate by the pinions 168 and 170, wherein a relative rotation to one another occurs. The transmission ratio results in accordance with equation (1) above.

The gear wheel gearing device, which is formed by the gear wheels 160, 162 and by the pinions 168 and 170 and is positioned in the interior space 104 of the head 58, is self-locking.

The first area 142 as spool supporting area is rotatable relative to the second area 144 via rotation of the head 58 with a transmission ratio in accordance with equation (1).

The tuning peg 138 is particularly suitable for plucking instruments, such as guitars.

Figure 9:
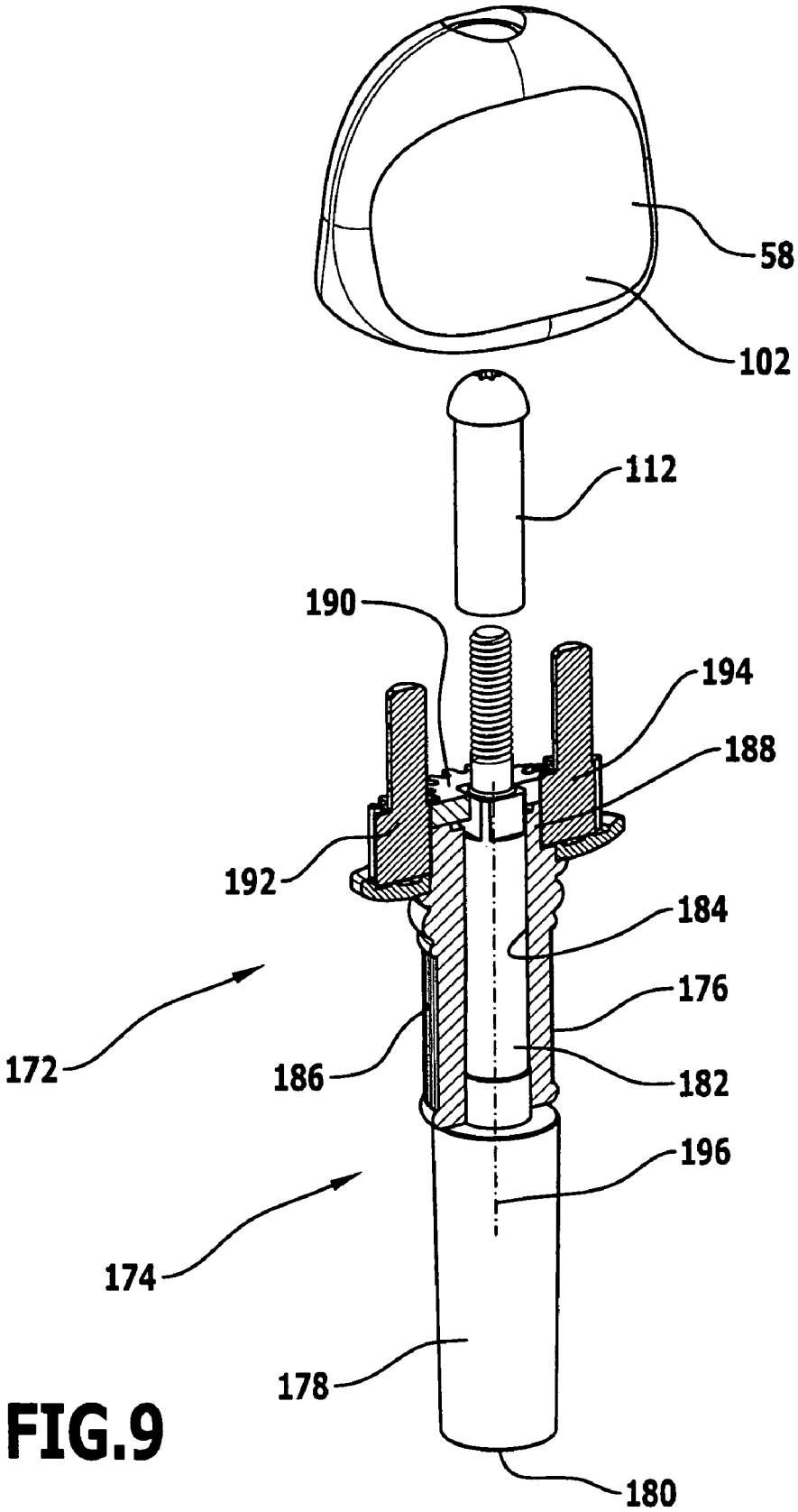
FIG. 9 shows a perspective exploded illustration of a third embodiment of a tuning peg according to the invention with a partial sectional view of a shank.

A third embodiment of a tuning peg, which is shown in FIG. 9 and designated in this case as 172, comprises a shank 174. This has a first area 176 which is a string supporting area. This first area 176 is followed by a second area 178 which is a mounting area for fixing to a musical instrument. The second area 178 has an end 180 which is a front end of the tuning peg 172.

A shaft 182 is non-rotatably seated on the second area 178. It is guided through an interior space 184 of the first area 176.

The first area 176 has a surface 186 which is a winding area for a string.

A first gear wheel 188 is, for example, arranged in one piece on the first area 176. A second gear wheel 190 is seated above this first gear wheel 188, connected non-rotatably to the shaft 182 and, therefore, non-rotatably to the second area 178. The first gear wheel 188 has a number of teeth $n_1$ and the second gear wheel 190 has a number of teeth $n_2$. The number of teeth $n_1$ differs from the number of teeth $n_2$.

Pinions 192, 194 act on the gear wheels 188 and 190. They move orbitally around an axis of rotation 196. A relative rotation of the first area 176 and the second area 178 relative to one another takes place with the transmission ratio specified in the above equation (1).

A head is, in principle, of the same design as that described in conjunction with the first embodiment 62 and the second embodiment 138. The same reference numerals are, therefore, used.

The second area 178 can, in principle, be cut to length.

Otherwise, the tuning peg 172 functions as described above in conjunction with the tuning pegs 62 and 138.

The tuning peg 172, with which the string supporting area 176 is arranged between the head 58 and the mounting area 178, may be used, for example, for a zither.

The tuning peg 62 has two mounting areas, namely the mounting areas 66 and 68, between which the first area 64 is arranged as string supporting area. The tuning pegs 138 and 172 have only one mounting area, namely the second area 144 and 178, respectively. In the case of the tuning peg 138, this mounting area 144 is arranged between the head 58 and the first area 142. In the case of the tuning peg 172, the string supporting area 176 is arranged between the head 58 and the mounting area 178.

The invention claimed is:

1. Tuning peg for a stringed musical instrument, comprising:

a shank with a first area forming a string supporting area and at least one additional area forming a mounting area for fixing the tuning peg to the stringed musical instrument;

the first area being rotatable relative to the at least one additional area;

a first gear wheel connected non-rotatably to the first area;

at least one additional gear wheel connected non-rotatably to the at least one additional area;

a head arranged on the shank so as to be rotatable about an axis of rotation; and at least one drive gear wheel arranged in the head and acting on the first gear wheel and the at least one additional gear wheel;

wherein:

an axis of rotation of the at least one drive gear wheel is parallel to an axis of rotation of at least one of the first gear wheel and the at least one additional gear wheel;

the at least one drive gear wheel rolls on the first gear wheel and the at least one additional gear wheel as a result of rotation of the head; and the first gear wheel and the at least one additional gear wheel are coaxially aligned.

2. Tuning peg as defined in claim 1, wherein the at least one drive gear wheel is arranged at least partially in an interior space of the head.

3. Tuning peg as defined in claim 1, wherein the at least one drive gear wheel is arranged so as to be offset in relation to the axis of rotation of the head.

4. Tuning peg as defined in claim 1, wherein the at least one drive gear wheel is rotatable about a drive gear wheel axis of rotation.

5. Tuning peg as defined in claim 4, wherein the at least one drive gear wheel axis of rotation is oriented parallel to the axis of rotation of the head on the shank.

6. Tuning peg as defined in claim 1, wherein the at least one drive gear wheel is or comprises a pinion.

7. Tuning peg as defined in claim 1, wherein the first gear wheel is positioned in an interior space of the head.

8. Tuning peg as defined in claim 1, wherein the at least one additional gear wheel is positioned in an interior space of the head.

9. Tuning peg as defined in claim 1, comprising a gear wheel gearing device comprising the first gear wheel, the at least one additional gear wheel and the at least one drive gear wheel and being positioned in an interior space of the head.

10. Tuning peg as defined in claim 1, wherein the first area and the at least one additional area follow one another on the shank in a longitudinal direction parallel to the axis of rotation of the head.

11. Tuning peg as defined in claim 1, comprising a second area and a third area forming respective mounting areas, wherein the at least one additional gear wheel comprises a second gear wheel connected non-rotatably to the second area and a third gear wheel connected non-rotatably to the third area.

12. Tuning peg as defined in claim 11, wherein the first area is located between the second area and the third area.

13. Tuning peg as defined in claim 11, wherein the second area, the first area and the third area follow one another on the shank in a longitudinal direction parallel to the axis of rotation of the head.

14. Tuning peg as defined in claim 11, wherein the second gear wheel is arranged on a pin element guided through the first area and the third area.

15. Tuning peg as defined in claim 14, wherein the pin element is rotatably mounted on the first area.

16. Tuning peg as defined in claim 14, wherein the pin element is rotatably mounted on a shaft, the first gear wheel being arranged on said shaft.

17. Tuning peg as defined in claim 11, wherein the third gear wheel is arranged coaxially to the first gear wheel.

18. Tuning peg as defined in claim 17, wherein the at least one drive gear wheel acts on the third gear wheel.

19. Tuning peg as defined in claim 11, wherein the third gear wheel is arranged in an interior space of the head.

20. Tuning peg as defined in claim 11, wherein the first gear wheel is arranged between the second gear wheel connected non-rotatably to the second area and the third gear wheel connected non-rotatably to the third area.

21. Tuning peg as defined in claim 11, wherein the second gear wheel connected non-rotatably to the second area and the third gear wheel connected non-rotatably to the third area have the same number of teeth.

22. Tuning peg as defined in claim 21, wherein the first gear wheel has a different number of teeth in comparison with at least one of the second gear wheel and the third gear wheel.

23. Tuning peg as defined in claim 1, wherein the first area is connected to a shaft, the first gear wheel being arranged on said shaft.

24. Tuning peg as defined in claim 23, wherein the shaft is guided through an additional area.

25. Tuning peg as defined in claim 24, wherein the shaft is rotatably mounted on the additional area.

26. Tuning peg as defined in claim 1, wherein the first gear wheel and the at least one additional gear wheel have a different number of teeth and/or the at least one drive gear wheel acts on the first gear wheel and the at least one additional gear wheel with a different number of teeth.

27. Tuning peg as defined in claim 1, wherein the first gear wheel has a greater number of teeth than the at least one additional gear wheel.

28. Tuning peg as defined in claim 1, wherein the number of teeth of the first gear wheel and/or the number of teeth of the at least one drive gear wheel acting on the first gear wheel differs by m+i from the number of teeth of the at least one additional gear wheel and/or the number of teeth of the at least one drive gear wheel acting on the at least one additional gear wheel, wherein m is a natural number and i the number of drive gear wheels acting on the first gear wheel and the at least one additional gear wheel and being spaced transversely to the axis of rotation.

29. Tuning peg as defined in claim 1, comprising a plurality of drive gear wheels arranged so as to be evenly distributed on the head in relation to the axis of rotation of the head.

30. Tuning peg as defined in claim 1, wherein the at least one drive gear wheel has a height at least as great as the overall height of a combination consisting of first gear wheel and at least one additional gear wheel.

31. Tuning peg as defined in claim 1, wherein an end of the tuning peg facing away from the head is formed on the at least one additional area.

32. Tuning peg as defined in claim 31, wherein the at least one additional area has an area adapted to be cut to length.

33. Tuning peg as defined in claim 1, wherein an end of the tuning peg facing away from the head is formed on the first area.

34. Tuning peg as defined in claim 1, wherein a gear wheel gearing device for the rotation of the first area via the first gear wheel by means of the at least one drive gear wheel is designed to be self-locking.

35. Tuning peg as defined in claim 1, wherein the at least one drive gear wheel moves orbitally about the axis of rotation of the head on the shank as a result of rotation of the head.

36. Tuning peg as defined in claim 1, wherein the head has at least one finger gripping surface.

37. Tuning peg for a stringed musical instrument, comprising:

a shank with a first area forming a string supporting area and at least one additional area forming a mounting area for fixing the tuning peg to the stringed musical instrument;

the first area being rotatable relative to the at least one additional area;

a first gear wheel connected non-rotatably to the first area;

at least one additional gear wheel connected non-rotatably to the at least one additional area;

a head arranged on the shank so as to be rotatable about an axis of rotation;

at least one drive gear wheel arranged on the head and acting on the first gear wheel and the at least one additional gear wheel; and a second area and a third area forming respective mounting areas;

wherein:

an axis of rotation of the at least one drive gear wheel is parallel to an axis of rotation of at least one of the first gear wheel and the at least one additional gear wheel;

the at least one additional gear wheel comprises a second gear wheel connected non-rotatably to the second area and a third gear wheel connected non-rotatably to the third area; and the second gear wheel connected non-rotatably to the second area and the third gear wheel connected non-rotatably to the third area have the same number of teeth.

38. Tuning peg as defined in claim 37, wherein the at least one additional gear wheel is arranged coaxially to the first gear wheel.

39. Tuning peg as defined in claim 37, wherein the at least one drive gear wheel rolls on the first gear wheel as a result of rotation of the head.

40. Tuning peg as defined in claim 37, wherein the first gear wheel has a different number of teeth in comparison with at least one of the second gear wheel and the third gear wheel.

* * * * *